US006231345B1

(12) United States Patent
Yamazaki et al.

(10) Patent No.: US 6,231,345 B1
(45) Date of Patent: May 15, 2001

(54) SHAPE FITTING TOY

(75) Inventors: Tomohiro Yamazaki; Hitoshi Itakura, both of Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/447,054

(22) Filed: Nov. 23, 1999

(30) Foreign Application Priority Data

Feb. 12, 1998 (JP) ..... 10-343420

(51) Int. Cl.[7] ..... G09B 19/00
(52) U.S. Cl. ..... 434/259; 446/76
(58) Field of Search ..... 446/1, 69, 71, 446/73, 74, 75, 76, 489; 439/259, 258, 211

(56) References Cited

U.S. PATENT DOCUMENTS

| | | | | |
|---|---|---|---|---|
| 3,787,987 | * | 1/1974 | Brass | 434/259 |
| 4,075,780 | * | 2/1978 | Linebaugh | 446/76 |
| 4,149,717 | * | 4/1979 | Seijiro | 434/259 |
| 4,610,637 | * | 9/1986 | Ferguson | 434/259 |
| 4,840,374 | | 6/1989 | Skinner . | |
| 5,139,453 | * | 8/1992 | Aiken et al. | 446/76 |
| 5,314,338 | * | 5/1994 | Caveza et al. | 434/259 |
| 5,924,908 | * | 7/1999 | O'Heir | 434/258 |

FOREIGN PATENT DOCUMENTS

| | | |
|---|---|---|
| 2826123 A1 | 12/1979 | (DE) . |
| 2 253 935 | 9/1992 | (GB) . |
| 2253935A | 9/1992 | (GB) . |
| 2324048A | 10/1998 | (GB) . |

* cited by examiner

*Primary Examiner*—Sam Rimell
(74) *Attorney, Agent, or Firm*—Staas & Halsey LLP

(57) ABSTRACT

A shape fitting toy comprising: a plurality of blocks having different types of shapes from each other, and a block selection part having a plurality of block passing holes each of which has a shape corresponding to one of the blocks having a plurality of different shapes and can pass only a corresponding one of the blocks. Each of the different types of shapes of the blocks is selected from a group consisting of a sphere and various types of regular polyhedrons.

18 Claims, 2 Drawing Sheets

SHAPE FITTING TOY

BACKGROUND OF THE INVENTION

1. Field of the Invention

The present invention relates to a shape fitting toy which includes: blocks having a plurality of different shapes from each other, and a block selection part having a plurality of block passing holes each of which has a shape corresponding to one of the blocks having a plurality of different shapes and can pass only a corresponding one of the blocks therethrough.

2. Description of Related Art

Conventionally, the following shape fitting toy is known.

A conventional shape fitting toy comprises: blocks having shapes of a cylinder, triangle pole, and a rectangular parallelopiped; and a container having a plurality of block passing holes each of which has a shape corresponding to one of the blocks having the shapes and can pass only a corresponding one of the blocks. The block passing holes have a circular shape for passing a cylindrical block, triangular shape for passing a triangle pole block, and a quadrangular shape for passing a rectangular parallelopiped block.

In order to play with such a shape fitting toy, in a first manner, for example, if a triangle pole block is selected as a block first, and a block passing hole having a shape which corresponds to the shape of the end surface of the triangle pole block, that is, the block passing hole having a triangular shape similar to and a little larger than the shape of the end surface of the triangle pole block, is selected. Then, the end surface of the triangle pole block is faced to the corresponding block passing hole and the direction or position of the end surface of the triangle pole block is made correspond to that of the block passing hole. With keeping this state, the block is passed through the block passing hole.

In a second manner, for example, first, the block passing hole having a triangular shape is selected as one of the block passing holes and thereafter a block having a shape which corresponds to the block passing hole having a triangular shape, that is, a triangle pole block, is selected. Then, the end surface of the triangle pole block is faced to the corresponding block passing hole and the direction or position of the end surface of the triangle pole block is made correspond to that of the block passing hole. With keeping this state, the block is passed through the block passing hole. When the selected block is a cylindrical block, or when the selected block passing hole is a cylindrical hole, it is unnecessary to make correspond the direction or position of the end surface of the block to that of the block passing hole after facing the end surface of the block to the corresponding block passing hole.

According to the shape fitting toy, when using a triangle pole block or a rectangular parallelopiped block, in order to pass a block through the corresponding block passing hole, two operations of a figure selection and a direction or position correspondence are required. That is, it is necessary not only to select a block passing hole having a shape which corresponds to the selected block or to select a block having a shape which corresponds to the selected block passing hole but also to face the end surface of the block to the corresponding block passing hole and to make correspond the direction or position of the end surface of the block to that of the block passing hole.

Although such a shape fitting toy is suited as an intellectual toy for children who have reached a certain age, it is too difficult for a baby, an intellectually handicapped person, a sightless person or the like to play it.

SUMMARY OF THE INVENTION

The invention has been made in view of the above problems.

It is an object of the invention to provide a shape fitting toy suitable for the ability of a baby or the like.

That is, in accordance with one aspect of the present invention, the shape fitting toy comprises: a plurality of blocks having different types of shapes from each other, and a block selection part having a plurality of block passing holes each of which has a shape corresponding to one of the blocks having a plurality of different shapes and can pass only a corresponding one of the blocks, wherein each of the different types of shapes is selected from a group consisting of a sphere and various types of regular polyhedrons.

Preferably, the plurality of blocks having different shapes comprise a spherical block and a regular polyhedral block. The plurality of blocks having different shapes may consist of a spherical block and a regular polyhedral block, and may further comprise a block having another different shape.

The plurality of blocks having different shapes may comprise plural types of regular polyhedral blocks in which numbers of surfaces thereof are different from one another. The plurality of blocks having different shapes may consist of plural types of regular polyhedral blocks, and may further comprise a block having another different shape.

The plurality of blocks having different shapes may comprise at least two blocks selected from the group consisting of a spherical block, a tetrahedral block having an equilateral triangular surface and a regular hexahedral block. The blocks may consist of at least two blocks selected from the group consisting of a spherical block, a tetrahedral block and a regular hexahedral block, and may further comprise a block having another different shape.

The plurality of blocks having different shapes may comprise a spherical block, a regular tetrahedral block and a regular hexahedral block. The blocks may consist of a spherical block, a regular tetrahedral block and a regular hexahedral block, and may further comprise a block having another different shape.

The plurality of blocks having different shapes consist of a spherical block, a regular tetrahedral block and a regular hexahedral block.

According to the shape fitting toy of the invention, the block can be passed through the corresponding block passing hole from any one of at least 3 sides or positions of the block. Therefore, if a child or the like can make correspond a block to the block passing hole therefor, the block can be passed through the block passing hole easily by placing the block on the block selection part in the vicinity of the block passing hole and by rotating the regular polyhedral block a little if necessary.

In the case of a tetrahedral block having an equilateral triangular surface, when the block passing hole is formed in an equilateral triangular shape, the tetrahedral block can be also passed through the block passing hole easily by directing an apex opposite to the equilateral triangular surface, to the block passing hole, without directing the equilateral triangular surface to the block passing hole. In particular, if the surfaces other than the equilateral triangular surface are isosceles triangle having the same size, it is possible to pass the tetrahedral block through the corresponding block passing hole more easily.

Preferably, the block passing holes are formed in a container for receiving the blocks therein. According to such a shape fitting toy, because of having a container for receiving the blocks therein, it is possible to clean up the used blocks in order easily.

The container preferably comprises: a cylindrical main body which has openings at both ends and is bent in an L-shape, and the block selection part which covers an end opening of the cylindrical main body. The container may further comprise a block entrance and exit part which covers the other end opening of the main body and has a disc-shaped plastic plate in which a through hole is formed at the center thereof and a large number of slits are formed from the through hole in a radial manner. Preferably, the container further comprises a supporting portion which is attached to the main body to keep the container in a standing-up state.

In accordance with another aspect of the present invention, the shape fitting toy comprises: a plurality of blocks having different shapes which comprise having different shapes comprise a spherical block, a regular tetrahedral block and a regular hexahedral block; a cylindrical main body which has openings at both ends and is bent in an approximately L-shape; a block selection part which covers an end opening of the cylindrical main body and has a circular shaped passing hole for passing the spherical block therethrough, an equilateral triangular shaped passing hole for passing the regular tetrahedral block, and a square shaped passing hole for passing the regular hexahedral block; a block entrance and exit part which covers the other end opening of the main body and has a disc-shaped plastic plate in which a through hole is formed at the center thereof and a large number of slits are formed from the through hole in a radial manner; and a supporting portion which is attached to a surface of an outer bending portion of the main body in a direction perpendicular to a central axis of the container, to help for keeping the container in a standing-up state.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

The shape fitting toy according to an embodiment of the present invention will be explained, as follows.

Figure 1:
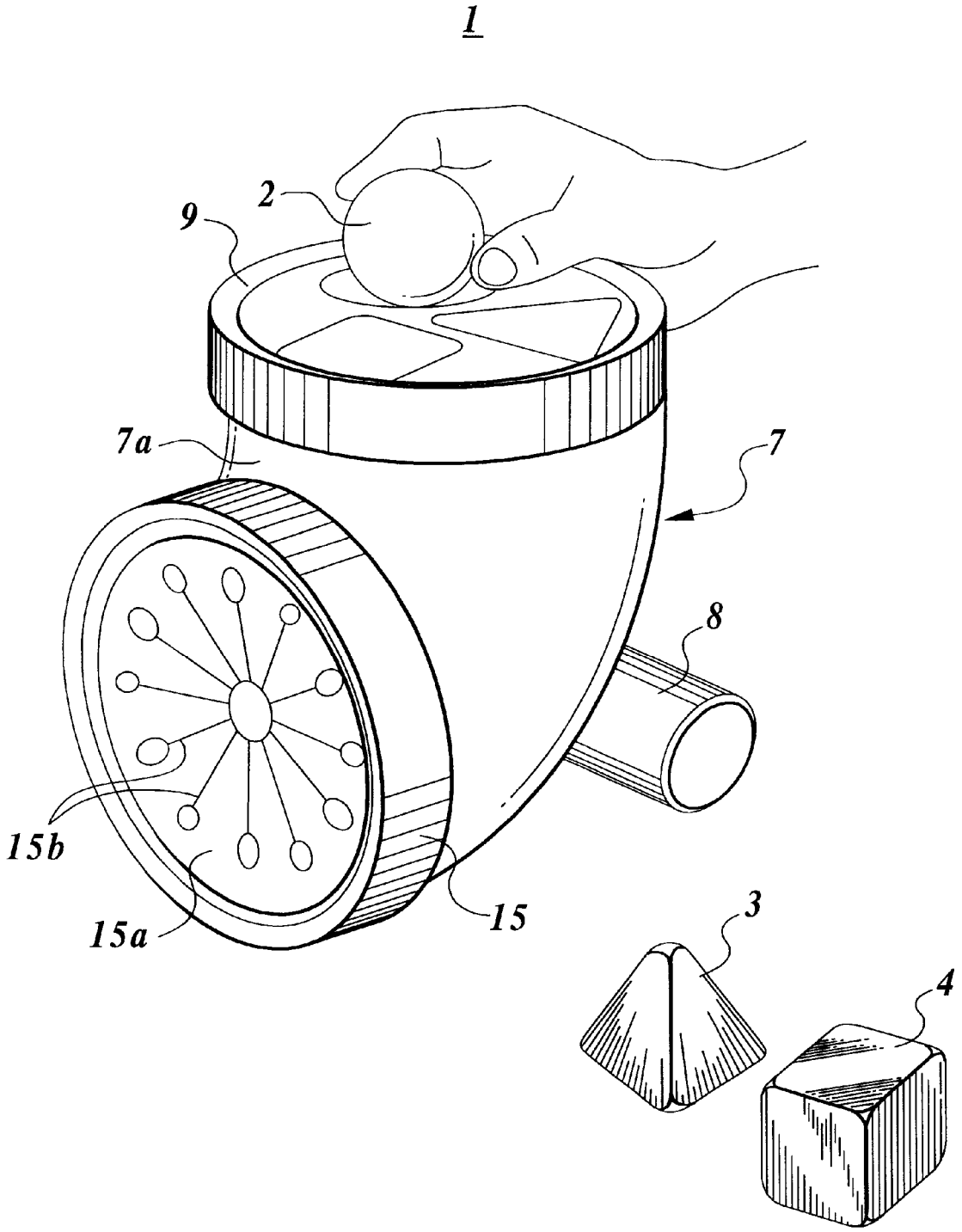
FIG. 1 is a perspective view of the shape fitting toy according to an embodiment of the present invention.

The shape fitting toy 1 according to the embodiment comprises a spherical block 2, a regular tetrahedral block 3, a regular hexahedral block 4 and a cylindrical container 7, as shown in FIG. 1.

Each of the spherical block 2, the regular tetrahedral block 3 and the regular hexahedral block 4 is made of plastic and has a size that a small child can carry in one hand. All edge portions of the regular tetrahedral block 3 and the regular hexahedral block 4 are made round to be agreeable to the touch. Although each of the surfaces of the blocks 2, 3 and 4 are a complete spherical surface or a flat plane in this embodiment, it may be provided with some dimples or the like, on the surfaces thereof. The block may have a hollow therein and holes in some surfaces, for communicating the outside with the hollow.

The cylindrical container 7 is made of plastic and has an elbow-like shape. On the outside surface of the curvature portion of the main body 7*a* of the container, a pipe-shaped supporting portion 8 is attached in a direction perpendicular to the central axis of the container, to help for keeping the container in a standing-up state. By bringing the outer surface of the supporting portion 8 and the peripheral surface of an end of the container 7 into contact with the floor or the like, the container 7 can be kept in a standing-up state stably. The main body 7*a* of the container 7 has a structure like a cylinder bent in an L-shape or a J-shape.

Figure 2:
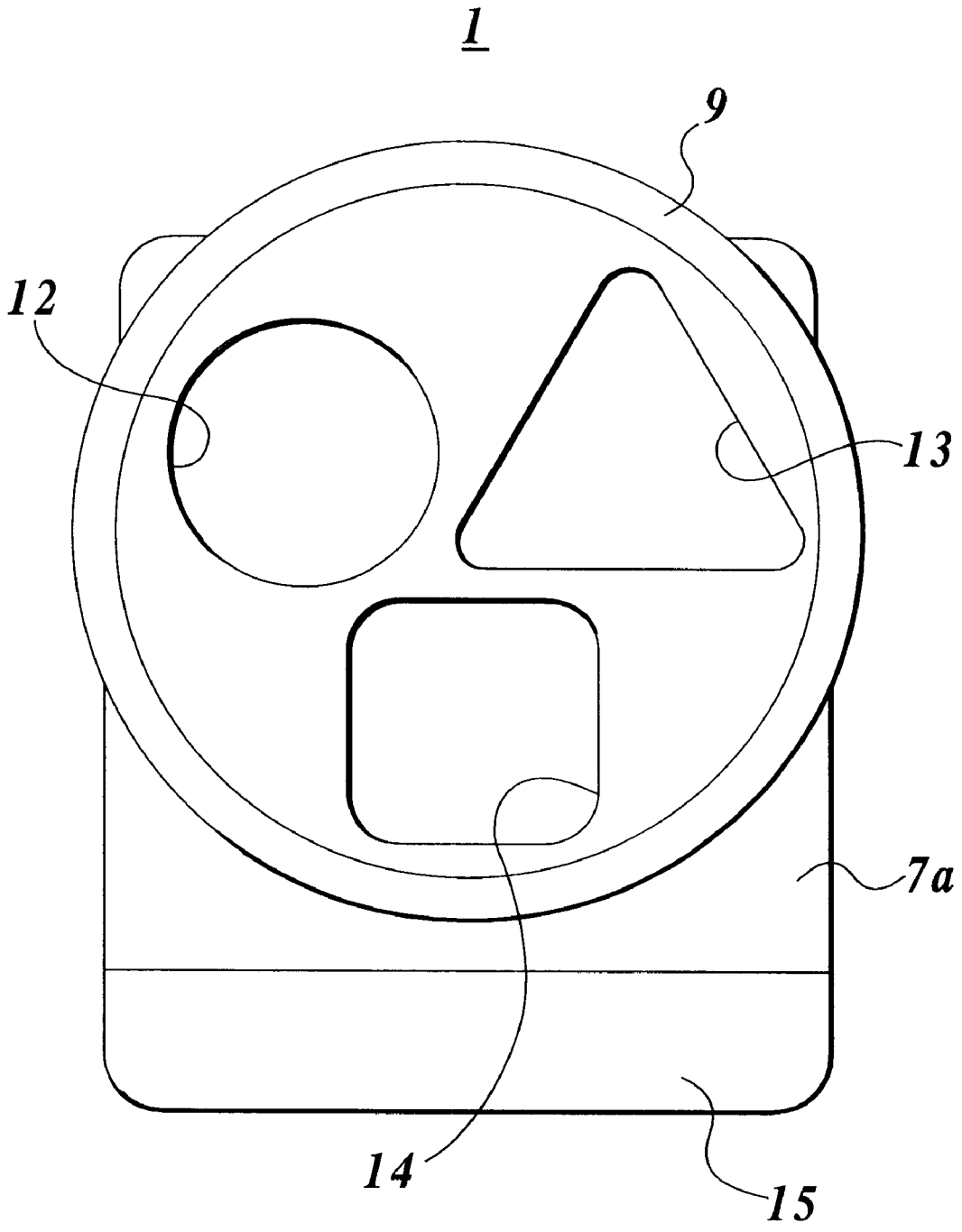
FIG. 2 is a plan view of the shape fitting toy according to the embodiment.

At an end opening of the main body 7*a*, a cover-like block selection part 9 which is made of plastic is detachably attached. The block selection part 9 is attached to the main body 7*a* to cover the end opening of the main body 7*a*. In the block selection part 9, a circular shaped block passing hole 12 for passing a spherical block 2 therethrough, an equilateral triangular shaped block passing hole 13 for passing a tetrahedral block 3, and a square shaped block passing hole 14 for passing a regular hexahedral block 4 are formed, as shown in FIG. 2.

On the other hand, at the other end opening of the main body 7*a*, a cover-like block entrance and exit part 15 is attached. The block entrance and exit part 15 is attached to the main body 7*a* to cover the other end opening of the main body 7*a*. The block entrance and exit part 15 has a disc-shaped plastic plate 15*a*. In the disc-shaped plastic plate 15*a*, a through hole is formed at the center thereof and a large number of slits 15*b* are formed from the central through hole in a radial manner. The slits 15*b* are communicated with through holes which are formed near the periphery of the plastic plate 15*a*, respectively.

Although a plastic plate is used as the plate 15*a*, of course, a rubber plate can be also used. The disc-shaped plastic plate 15*a* with a through hole and a large number of slits 15*b* is made of a comparatively soft and flexible material so that a small child can put his/her hand into the container 7 through the plate 15*a* easily.

Next, how to play the shape fitting toy will be explained about (1) the case of the block selection part 9 being at an upper position and (2) the case of the block entrance and exit part 15 being at an upper position.

(1) Case of the block selection part 9 being at an upper position:

(i) First, the case of a spherical block 2 being selected will be explained. The circular shaped block passing hole 12 corresponding to the spherical block 2 is found out. After the circular shaped block passing hole 12 is found out, the spherical block 2 is positioned just above the circular shaped block passing hole 12. The spherical block 2 is dropped into the circular shaped block passing hole 12. On the other hand, in the case of the circular shaped block passing hole 12 being selected first, almost the same operations as the case of a spherical block 2 being selected first are carried out, except that thereafter a spherical block 2 corresponding to the selected circular shaped block passing hole 12 is found out.

(ii) Next, the case of a tetrahedral block 3 being selected will be explained. The equilateral triangular shaped block passing hole 13 corresponding to the tetrahedral block 3 is found out. After the equilateral triangular shaped block passing hole 13 is found out, the tetrahedral block 3 is positioned just above the equilateral triangular shaped block passing hole 13. In this case, it may direct a triangular surface of the tetrahedral block 3 to the equilateral triangular shaped block passing hole 13 and also may direct an apex of the tetrahedral block 3 to the equilateral triangular shaped block passing hole 13. In the case of directing a triangular surface of the tetrahedral block 3 to the equilateral triangular shaped block passing hole 13, it is required to make correspond the position of the tetrahedral block 3 to the equilateral triangular shaped block passing hole 13. Then, the tetrahedral block 3 is dropped into the equilateral triangular shaped block passing hole 13. On the other hand, in the case of the equilateral triangular shaped block passing hole 13 being selected first, almost the same operations as the case of a tetrahedral block 3 being selected first are carried out, except that thereafter a tetrahedral block 3 corresponding to the equilateral triangular shaped block passing hole 13 is found out.

(iii) Next, the case of a regular hexahedral block 4 being selected will be explained. The square shaped block passing hole 14 corresponding to the regular hexahedral block 4 is found out. After the square shaped block passing hole 14 is found out, the regular hexahedral block 4 is positioned just above the square shaped block passing hole 14. In this case, it is required to make correspond the position of the regular hexahedral block 4 to the square shaped block passing hole 14. Then, the regular hexahedral block 4 is dropped into the square shaped block passing hole 14. On the other hand, in the case of the square shaped block passing hole 14 being selected first, almost the same operations as the case of a regular hexahedral block 4 being selected first are carried out, except that thereafter a regular hexahedral block 4 corresponding to the square shaped block passing hole 14 is found out.

In the case of the block selection part 9 being at an upper position, taken-out of the blocks in the container 7 are carried out from the upper side by removing the block selection part 9 from the main body of the container 7 or carried out by putting a hand in the container through the plastic plate 15*a* of the block entrance and exit part 15.

(2) Case of the block entrance and exit part 15 being at an upper position:

A block is selected first and is placed on the plastic plate 15*a*. Then, when pushing the block from the upper side, the plastic plate 15*a* bends downwardly and the block drops into the container.

In the case of the block entrance and exit part 15 being at an upper position, taken-out of the blocks in the container 7 are carried out from the lower side by removing the block selection part 9 from the main body of the container 7 or carried out by putting a hand in the container through the plastic plate 15*a* of the block entrance and exit part 15. The block selection part 9 may be removed from the main body in advance.

Although some embodiments of the invention have been explained as described above, it should also be understood that the present invention is not limited to the embodiments and that various changes and modifications may be made to the invention without departing from the gist thereof.

Some representative effect of the intellectual toy of the invention will be explained, as follows.

The shape fitting toy according to the present invention comprises: a plurality of blocks having different types of shapes from each other, and a block selection part having a plurality of block passing holes each of which has a shape corresponding to one of the blocks having a plurality of different shapes and can pass only a corresponding one of the blocks, wherein each of the different types of shapes is selected from a group consisting of a sphere and various types of regular polyhedrons.

Accordingly, if a small child or the like can make correspond a block to the block passing hole therefor, the block can be passed through the block passing hole easily by placing the block on the block selection part in the vicinity of the block passing hole and by rotating the regular polyhedral block a little if necessary.

The entire disclosure of Japanese Patent Application No. Tokugan hei-10-343420 filed on Dec. 2, 1998 including specification, claims, drawings and summary are incorporated herein by reference in its entirety.

What is claimed is:

1. A shape fitting toy comprising:

a plurality of blocks having different types of shapes from each other, and a container comprised of a cylindrical main body which has openings at both ends and is bent in an approximately L-shape, a block selection part which covers an end opening of the cylindrical main body, said block selection part having a plurality of block passing holes formed therein, each of which has a shape corresponding to one of the blocks having a plurality of different shapes and can pass only a corresponding one of the blocks, and a block entrance and exit part which covers the other end opening of the main body and has a disc-shaped plastic plate in which a through hole is formed at the center thereof and a large number of slits are formed from the through hole in a radial manner, wherein each of the different types of shapes is selected from a group consisting of a sphere and various types of regular polyhedrons.

2. A shape fitting toy as claimed in claim 1, wherein the plurality of blocks having different shapes comprise a spherical block and a regular polyhedral block.

3. A shape fitting toy as claimed in claim 1, wherein the plurality of blocks having different shapes comprise plural types of regular polyhedral blocks in which numbers of surfaces thereof are different from one another.

4. A shape fitting toy as claimed in claim 1, wherein the plurality of blocks having different shapes comprise at least two blocks selected from the group consisting of a spherical block, a tetrahedral block having an equilateral triangular surface, and a regular hexahedral block.

5. A shape fitting toy as claimed in claim 1, wherein the plurality of blocks having different shapes comprise a spherical block, a regular tetrahedral block and a regular hexahedral block.

6. A shape fitting toy as claimed in claim 1, wherein the plurality of blocks having different shapes consist of a spherical block, a regular tetrahedral block and a regular hexahedral block.

7. A shape fitting toy comprising:

a plurality of blocks having different types of shapes from each other, and a container comprised of a cylindrical main body which has openings at both ends and is bent in an approximately L-shape, a block selection part which covers an end opening of the cylindrical main body, said block selection part having a plurality of block passing holes formed therein, each of which has a shape corresponding to one of the blocks having a plurality of different shapes and can pass only a corresponding one of the blocks, a block entrance and exit part which covers the other end opening of the main body and has a disc-shaped plastic plate in which a through hole is formed at the center thereof and a large number of slits are formed from the through hole in a radial manner, and a supporting portion which is attached to a surface of an outer bending portion of the main body in a direction perpendicular to a central axis of the container, to help for keeping the container in a standing-up state, wherein each of the different types of shapes is selected from a group consisting of a sphere and various types of regular polyhedrons.

8. A shape fitting toy as claimed in claim 7, wherein the plurality of blocks having different shapes comprise a spherical block and a regular polyhedral block.

9. A shape fitting toy as claimed in claim 7, wherein the plurality of blocks having different shapes comprise plural types of regular polyhedral blocks in which numbers of surfaces thereof are different from one another.

10. A shape fitting toy as claimed in claim 7, wherein the plurality of blocks having different shapes comprise at least two blocks selected from the group consisting of a spherical block, a tetrahedral block having an equilateral triangular surface and a regular hexahedral block.

11. A shape fitting toy as claimed in claim 7, wherein the plurality of blocks having different shapes comprise a spherical block, a regular tetrahedral block and a regular hexahedral block.

12. A shape fitting toy as claimed in claim 7, wherein the plurality of blocks having different shapes consist of a spherical block, a regular tetrahedral block and a regular hexahedral block.

13. A shape fitting toy comprising:

a plurality of blocks having different shapes which comprise a spherical block, a regular tetrahedral block and a regular hexahedral block;

a cylindrical main body which has openings at both ends and is bent in an approximately L-shape;

a block selection part which covers an end opening of the cylindrical main body and has a circular shaped passing hole for passing the spherical block therethrough, an equilateral triangular shaped passing hole for passing the regular tetrahedral block, and a square shaped passing hole for passing the regular hexahedral block;

a block entrance and exit part which covers the other end opening of the main body and has a disc-shaped plastic plate in which a through hole is formed at the center thereof and a large number of slits are formed from the through hole in a radial manner; and a supporting portion which is attached to a surface of an outer bending portion of the main body in a direction perpendicular to a central axis of the container, to help for keeping the container in a standing-up state.

14. A shape fitting toy as claimed in claim 13, wherein the plurality of blocks having different shapes comprise a spherical block and a regular polyhedral block.

15. A shape fitting toy as claimed in claim 13, wherein the plurality of blocks having different shapes comprise plural types of regular polyhedral blocks in which numbers of surfaces thereof are different from one another.

16. A shape fitting toy as claimed in claim 13, wherein the plurality of blocks having different shapes comprise at least two blocks selected from the group consisting of a spherical block, a tetrahedral block having an equilateral triangular surface and a regular hexahedral block.

17. A shape fitting toy as claimed in claim 13, wherein the plurality of blocks having different shapes comprise a spherical block, a regular tetrahedral block and a regular hexahedral block.

18. A shape fitting toy as claimed in claim 13, wherein the plurality of blocks having different shapes consist of a spherical block, a regular tetrahedral block and a regular hexahedral block.

* * * * *